US007667671B2

(12) United States Patent
Kishi et al.

(10) Patent No.: US 7,667,671 B2
(45) Date of Patent: Feb. 23, 2010

(54) PLASMA DISPLAY DEVICE AND METHOD FOR DRIVING THE SAME

(75) Inventors: Tomokatsu Kishi, Yamato (JP); Naoki Itokawa, Kawasaki (JP); Takayuki Kobayashi, Machida (JP); Yasunobu Hashimoto, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 711 days.

(21) Appl. No.: 11/340,836

(22) Filed: Jan. 27, 2006

(65) Prior Publication Data

US 2006/0181488 A1 Aug. 17, 2006

(30) Foreign Application Priority Data

Jan. 28, 2005 (JP) ..... 2005-021994

(51) Int. Cl.
*G09G 3/28* (2006.01)

(52) U.S. Cl. ..... 345/60; 345/66

(58) Field of Classification Search ..... 345/60–68, 345/210, 212, 76, 204, 208; 315/169.3, 169.4; 313/581, 585, 584
See application file for complete search history.

(56) References Cited

U.S. PATENT DOCUMENTS 6,414,656 B1 * 7/2002 Hong ..... 345/60

FOREIGN PATENT DOCUMENTS

| | | |
|---|---|---|
| CN | 1299122 | 6/2001 |
| CN | 1426083 | 6/2003 |
| KR | 10-2004-0077523 | 9/2004 |
| WO | WO 98/21706 | 5/1998 |

OTHER PUBLICATIONS

Sung Soo Yang,Hyun Chul Kim,Sang Woo Ko,and Jae Koo Lee,"Application of Two-Dimensional Numerical Simulation for Luminous Efficiency Improvement in Plasma Display Panel Cell",Aug. 2003,IEEE Transaction on Plasma Science,vol. 31,No. 4,pp. 596-605.*

"Patent Abstracts of Japan", Japanese Patent Application Publication No. 2000-251746 dated Sep. 14, 2000. Abstract Only.

"Patent Abstracts of Japan", Japanese Patent Application Publication No. 2001-42817 dated Feb. 16, 2001. Abstract Only.

(Continued)

*Primary Examiner*—Regina Liang
(74) *Attorney, Agent, or Firm*—Staas & Halsey LLP

(57) ABSTRACT

There is provided a plasma display device that has a first, a second, and a third electrodes, phosphors emitting a light depending on discharges generated by applying voltages of the first to third electrodes, and a drive circuit for applying a pulse to the third electrode in every time discharge light emission is generated by applying an alternating pulse between the first and second electrodes, and the time at which the pulse of the third electrode reaches 50% of its amplitude in the trailing edge takes place before the time of the first peak of the light emission waveform.

18 Claims, 9 Drawing Sheets

OTHER PUBLICATIONS

Korean Patent Office Action, mailed Mar. 29, 2007 and issued in corresponding Korean Patent Application No. 10-2006-0008110.

Sung Soo Yang, et al., "Application of Two-Dimensional Numerical Simulation for Luminous Efficiency Improvement in Plasma Display Panel Cell," IEEE Transactions on Plasma Science, Aug. 2003, vol. 31, No. 4, pp. 596-605.

Extended European Search Report, dated Nov. 14, 2006, and issued in corresponding European Patent Application No. 06250409.7-2205.

Chinese Patent Office Action, mailed Feb. 15, 2008 and issued in corresponding Chinese Patent Application No. 2006100027495.

* cited by examiner 500x
501x
502x
Sg
Tg
Tw
502z
501z
500z
502y
501y
500y
503
80um
100um

PLASMA DISPLAY DEVICE AND METHOD FOR DRIVING THE SAME

CROSS-REFERENCE TO RELATED APPLICATIONS

This application is based upon and claims the benefit of priority from the prior Japanese Patent Application No. 2005-021994, filed on Jan. 28, 2005, the entire contents of which are incorporated herein by reference.

BACKGROUND OF THE INVENTION

1. Field of the Invention

The present invention relates to a plasma display device and a method for driving the same.

2. Description of the Related Art

A plasma display is a large-sized flat type display and begins to prevail as a home-use wall hanging type TV. Further distribution of the plasma display demands improved luminous efficiency and low power consumption.

In the patent document 1 (Japanese Patent Application Laid-open No. 2000-251746), which has disclosed a plasma display panel having auxiliary electrodes. In the patent document 2 (Japanese Patent No. 3573005), which has disclosed a method for driving a plasma display panel having the first, the second and the third electrodes.

SUMMARY OF THE INVENTION

An object of the present invention is to provide a plasma display device capable of realizing improvement in luminous efficiency and reduction in power consumption.

According to an aspect of the present invention, there is provided a plasma display device having the first, the second, and the third electrodes, phosphors emitting a light depending on discharges generated by voltage application of the first to third electrodes, and a drive circuit for applying a pulse to the third electrode in every discharge light emission generated by an alternating pulse application between the first and second electrodes. The time at which the pulse of the third electrode reaches 50% of its amplitude at the trailing edge takes place before the time of the first peak of the light emission waveform.

DETAILED DESCRIPTION OF THE PREFERRED EMBODIMENTS

Figure 1:
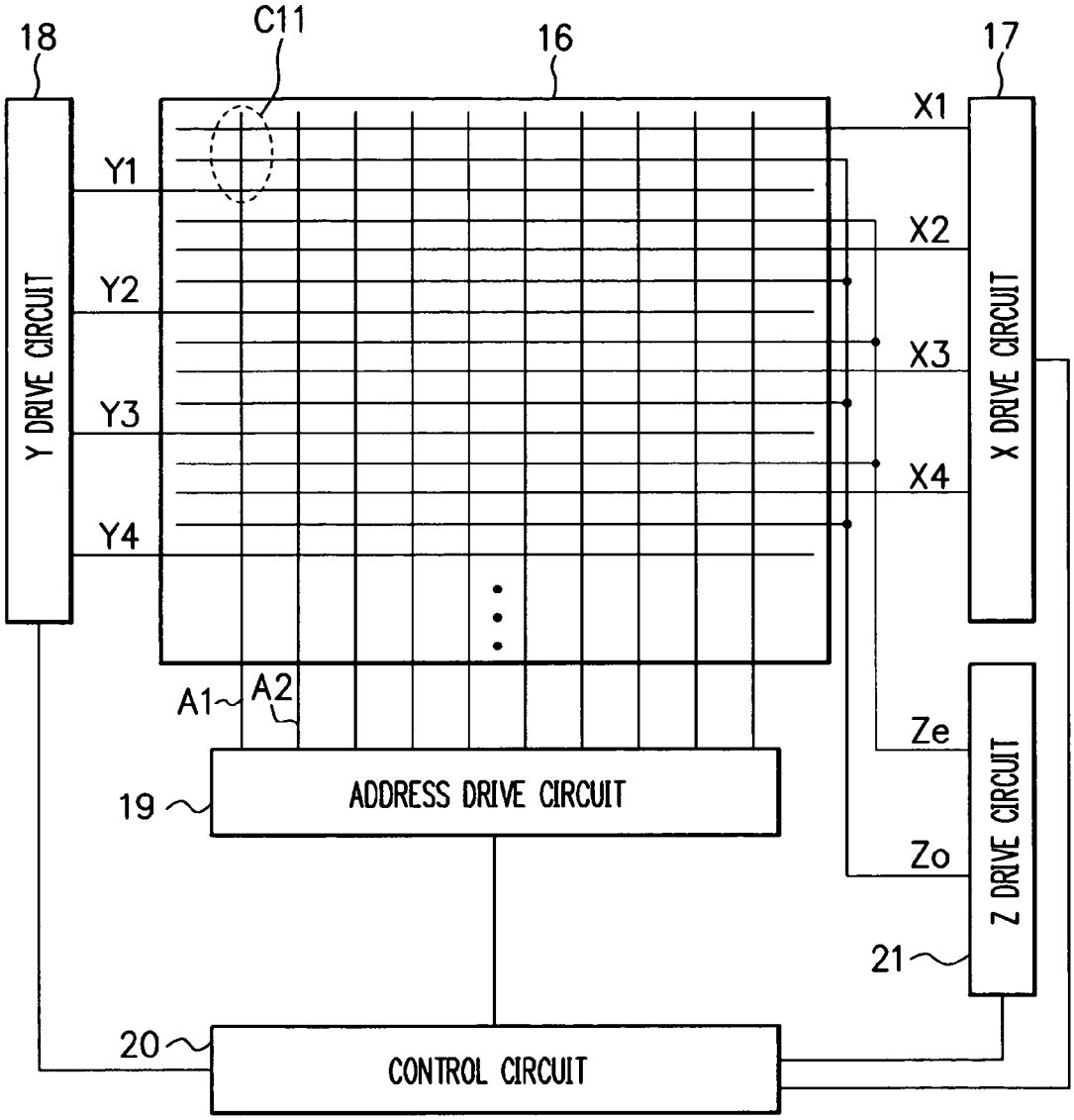
FIG. 1 is a view showing a four-electrode structured plasma display device in an embodiment of the present invention.

FIG. 1 is a view showing a configuration example of a four-electrode structured plasma display device according to an embodiment of the present invention. A control circuit 20 controls an X drive circuit 17, a Y drive circuit 18, a Z drive circuit 21, and an address drive circuit 19. The X drive circuit 17 supplies a predetermined voltage to plural X electrodes X1, X2, . . . . Hereinafter, each of the X1, X2, . . . , or all of the X1, X2, . . . are together referred to as the X electrode X. The Y drive circuit 18 supplies a predetermined voltage to plural Y electrodes Y1, Y2, . . . . Hereinafter, each of the Y1, Y2, . . . , or all of the Y1, Y2, . . . are together referred to as the Y electrode Y. The Z drive circuit 21 supplies a predetermined voltage to an odd-numbered Z electrode Zo and an even numbered Z electrode Ze. Hereinafter, each of the Z electrodes Zo and Ze, or all of the Z electrodes Zo and Ze are together referred to as the Z electrode Z. The address drive circuit 19 supplies a predetermined voltage to plural address electrodes A1, A2, . . . . Hereinafter, each of the A1, A2, . . . , or all of the A1, A2, . . . are together referred to as the address electrode A. The four-electrode structure has the address electrode A, the X electrode X, the Y electrode Y, and the Z electrode Z. The Z electrode Z is provided between the X electrode X and the Y electrode Y.

In a plasma display panel 16, the X electrode X, the Z electrode Z, and the Y electrode Y form a row extending horizontally and the address electrode A forms a column extending vertically. The address electrode A is provided so as to intersect the X electrode X, the Z electrode Z, and the Y electrode Y. The X electrode X, the Z electrode Z, and the Y electrode Y are arranged by turns in the vertical direction. A Y electrode Yi and an address electrode Aj form a two-dimensional matrix of i-rows and j-columns. A display cell C11 is formed of a crossing of a Y electrode Y1 and an address electrode A1, and the adjoining Z electrode Zo and an X electrode X1 corresponding thereto. The display cell C11 corresponds to a pixel. Due to the two-dimensional matrix, the panel 16 can display a two-dimensional image. The Z electrode Zo is an electrode for assisting a discharge between, for example, the X electrode X1 and the Y electrode Y1, and the Z electrode Ze is an electrode for assisting a discharge between, for example, the Y electrode Y1 and the X electrode X2.

Figure 2:
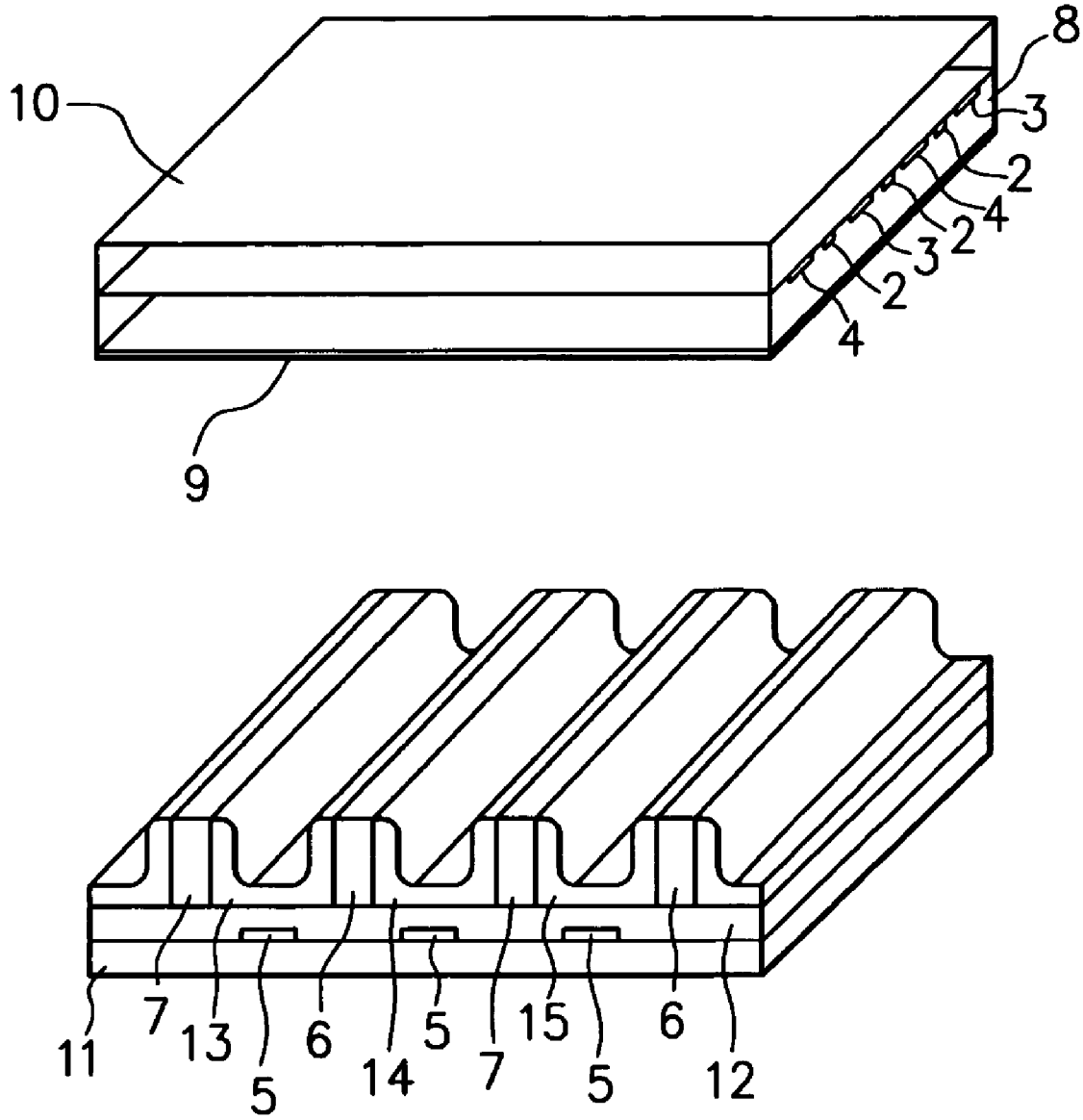
FIG. 2 is a perspective view of an exploded part showing a structure example of a plasma display panel in the present embodiment.

FIG. 2 is a perspective view of an exploded part showing a structure example of the panel 16 in the present embodiment. An X electrode 3 corresponds to the X electrode X in FIG. 1. A Y electrode 4 corresponds to the Y electrode Y in FIG. 1. A Z electrode 2 corresponds to the Z electrode Z in FIG. 1. An address electrode 5 corresponds to the address electrode A in FIG. 1.

The X electrode 3, the Y electrode 4, and the Z electrode 2 are formed on a front glass substrate 10. A first dielectric layer 8 is covered thereon in order to insulate a discharge space. An MgO (magnesium oxide) protective layer 9 is covered further thereon. On the other hand, the address electrode 5 is formed on a backside glass substrate 11 arranged in opposition to the front glass substrate 10. A second dielectric layer 12 is covered thereon. Phosphors 13 to 15 are covered further thereon. To the inner surface of partition walls 6 and 7, the red, blue, and green phosphors 13 to 15 are applied in a stripe-shaped arrangement for each color. By a sustain discharge between the X electrode 3 and the Y electrode 4, the phosphors 13 to 15 are excited to emit light in each color. Into the discharge space between the front glass substrate 10 and the backside glass substrate 11, Ne+Xe Penning gas (discharge gas) etc. is sealed.

Figure 3:
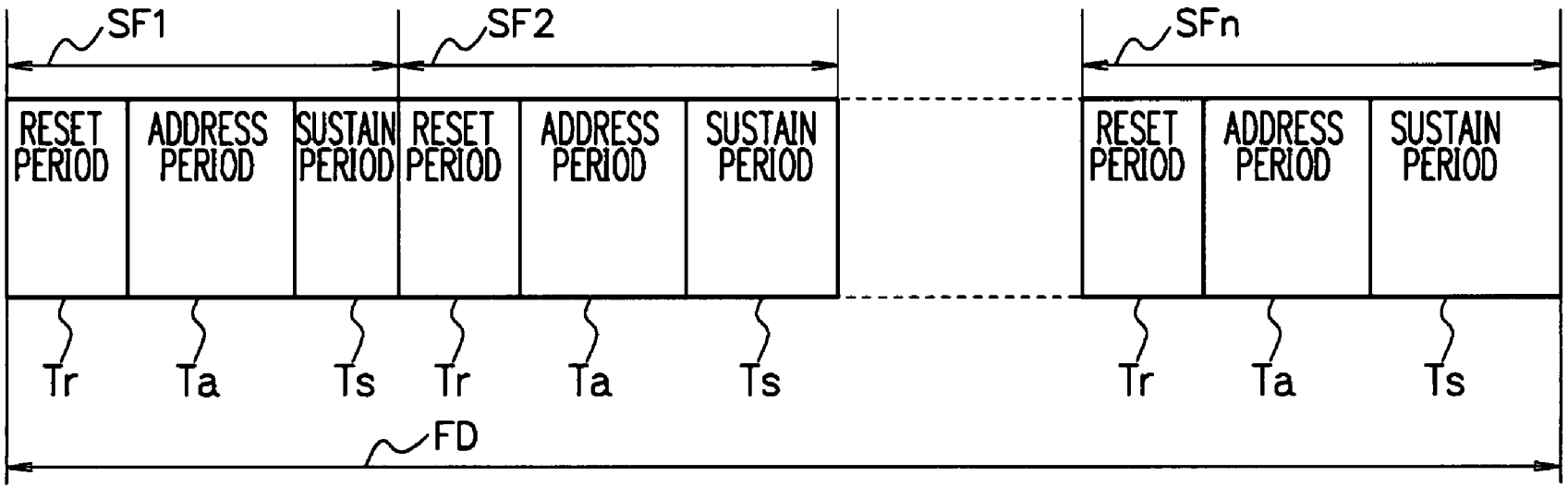
FIG. 3 is a diagram showing a configuration example of one frame of an image.

FIG. 3 is a diagram showing a configuration example of one frame FD of an image. The one frame FD is formed of a first subframe SF1, a second subframe SF2, . . . , a n-th subframe SFn. For example, n is 10, corresponding to the number of gradation bits. Hereinafter, each of the subframes SF1, SF2, etc., or all of them are together referred to as the subframe SF.

Each subframe SF is composed of a reset period Tr, an address period Ta, and a sustain (sustain discharge) period Ts. In the reset period Tr, initialization of the display cell is performed. In the address period Ta, it is possible to select to cause each display cell to or not to emit light by an address discharge between the address electrode A and the Y electrode Y. Specifically, by applying a scan pulse sequentially to the Y electrodes Y1, Y2, Y3, Y4, . . . , and selecting an address pulse for the address electrode A corresponding to the scan pulse, it is possible to select to cause a desired display cell to or not to emit light. In the sustain period Ts, a sustain discharge is made to perform between the X electrode X and the Y electrode Y in the selected display cell using the Z electrode Z for light emission. The number of times of light emission (the length of the sustain period Ts) by the sustain pulse between the X electrode X and the Y electrode Y differs in respective subframes SF. Due to this, the value of gradation can be determined.

In an odd-numbered frame FD, a display is produced by sustain discharges in the display cell between the X electrode X1 and the Y electrode Y1, the display cell between the X electrode X2 and the Y electrode Y2, the display cell between the X electrode X3 and the Y electrode Y3, the display cell between the X electrode X4 and the Y electrode Y4, etc. At this time, the sustain discharge is made to perform using the Z electrode Zo. Then, in an even-numbered frame FD, a display is produced by sustain discharges in the display cell between the Y electrode Y1 and the X electrode X2, the display cell between the Y electrode Y2 and the X electrode X3, the display cell between the Y electrode Y3 and the X electrode X4, etc. At this time, the sustain discharge is made to perform using the Z electrode Ze.

Figure 4B:
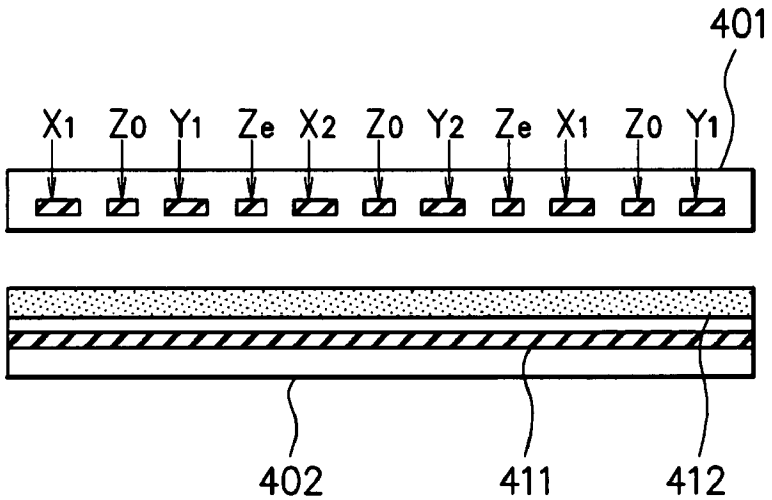
FIG. 4B is a cross sectional view of the plasma display panel in FIG. 4A.
Figure 4A:
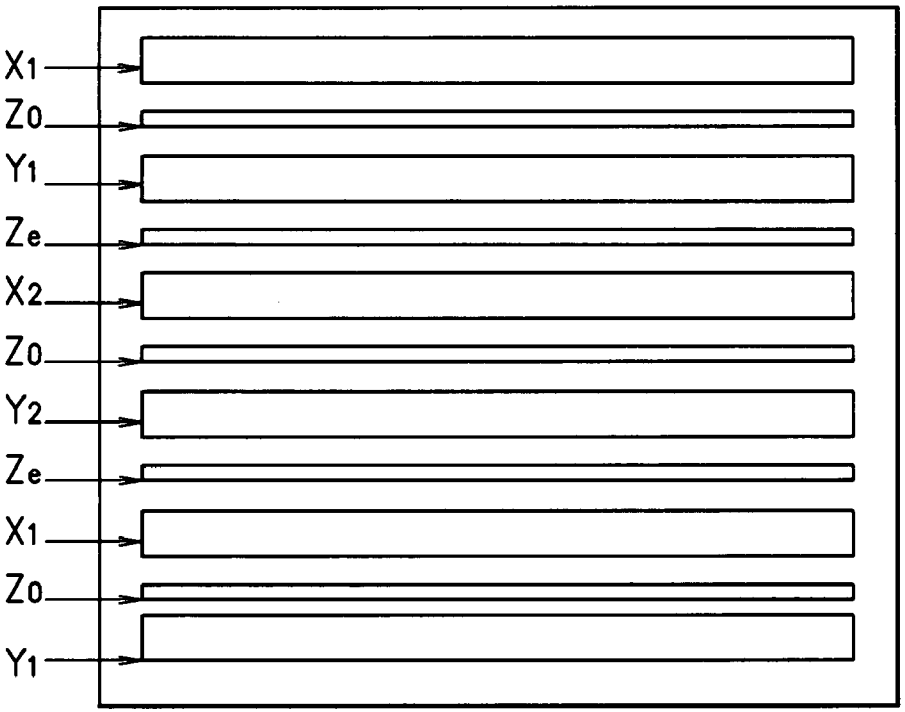
FIG. 4A is a top plan view of an ALIS structured plasma display panel in the present embodiment used in an experiment.

FIG. 4A is a top plan view of an ALIS structured plasma display panel in the present embodiment used in an experiment and FIG. 4B is a cross sectional view of the plasma display panel in FIG. 4A. The X electrode X1 shows the odd-numbered X electrodes X1, X3, etc., in FIG. 1 and the X electrode X2 shows the even-numbered X electrodes X2, X4, etc., in FIG. 1. The Y electrode Y1 shows the odd-numbered Y electrodes Y1, Y3, etc., in FIG. 1 and the Y electrode Y2 shows the even-numbered Y electrodes Y2, Y4, etc., in FIG. 1. A front substrate 401 is provided with the X electrodes X1 and X2, the Y electrodes Y1 and Y2, and the Z electrodes Zo and Ze. A backside substrate is provided with an address electrode 411 and a phosphor layer 412.

In the ALIS drive, an odd frame and an even frame are displayed by turns. The odd frame and the even frame differ in the position of a display cell that emits light and differ in combination of electrodes used for display. Specifically, in the odd frame, the electrodes X1, Zo, and Y1 form a combination of display electrodes and the electrodes X2, Zo, and Y2 form another combination. At this time, the Z electrode Ze is not used as a display electrode but used as a barrier electrode for suppressing interference between display cells. When using the Z electrode Ze as a barrier electrode, the Z electrode Ze is fixed to the ground. Then, when a frame is the even frame, the electrodes Y1, Ze, and X2 form a combination of display electrodes and the electrodes Y2, Ze, and X1 form another combination. In this case, the Z electrode Zo results in a barrier electrode.

Figures 5A, 5B:
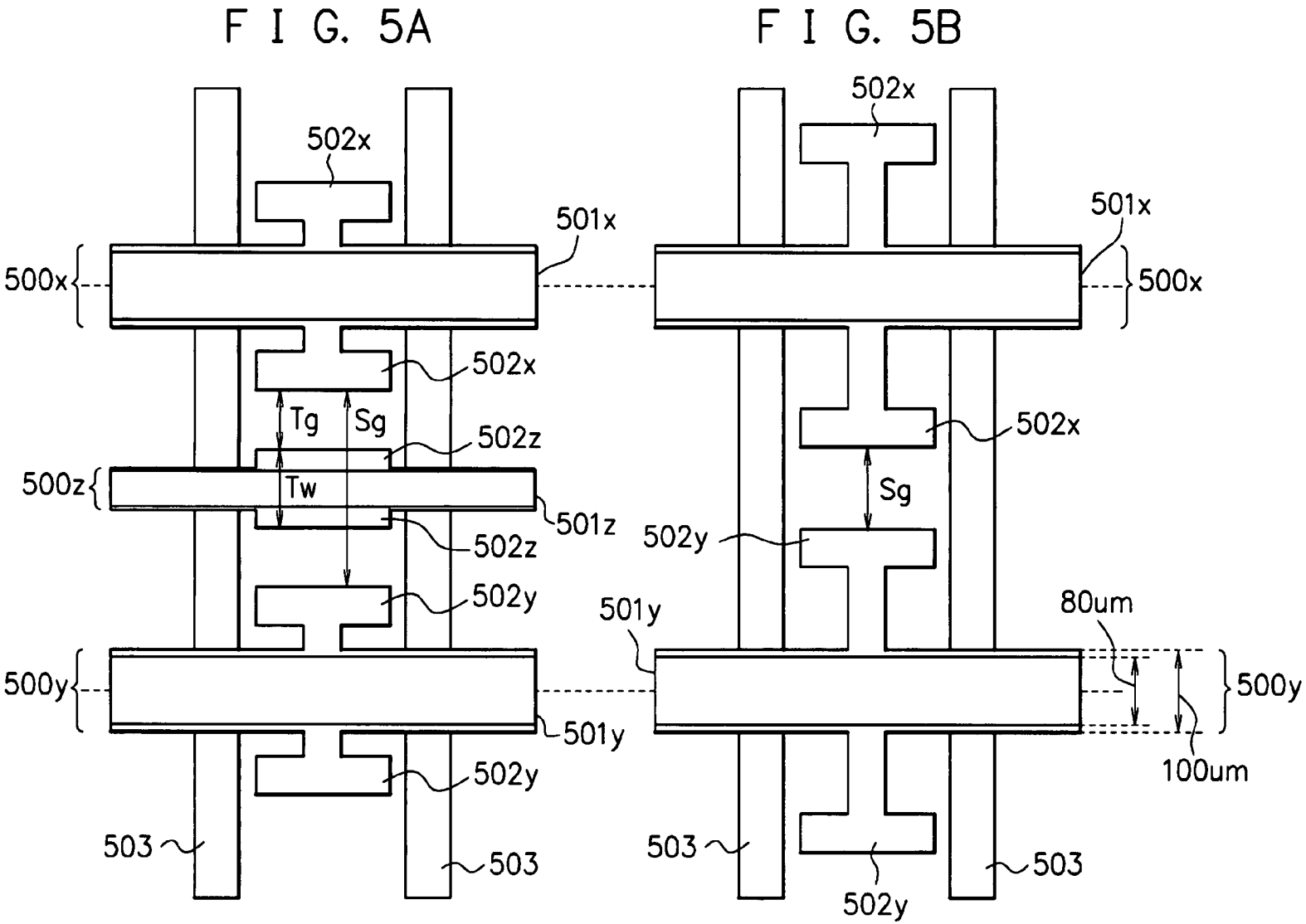
FIG. 5A is a diagram showing electrode structures.
FIG. 5B is a diagram showing electrode structures.

FIG. 5A shows an electrode structure used in the experiment. An X electrode 500*x* is composed of a metal electrode (bus electrode) 501*x* and transparent electrodes (sustain electrodes) 502*x* connected to both sides thereof. A Y electrode 500*y* is composed of a metal electrode (bus electrode) 501*y* and transparent electrodes (sustain electrodes) 502*y* connected to both sides thereof. A Z electrode 500*z* is composed of a metal electrode (bus electrode) 501*z* and transparent electrodes (sustain electrodes) 502*z* connected to both sides thereof. Partition walls 503 correspond to the partition walls 6 and 7 in FIG. 2.

A sustain discharge is made to perform between the transparent electrodes 502*x* and 502*y*. A minimum distance Sg between the transparent electrodes 502*x* and 502*y* is 250 μm. A minimum distance Tg between the transparent electrodes 502*x* and 502*z* is 75 μm. A minimum distance Tg between the transparent electrodes 502*y* and 502*z* is also 75 μm. A maximum width Tw of the transparent 502*z* is 100 μm. A minimum width of the transparent electrodes 502*x* and 502*y* is 100 μm. The width of the metal electrodes 501*x* and 501*y* is 80 μm.

Figure 6B:
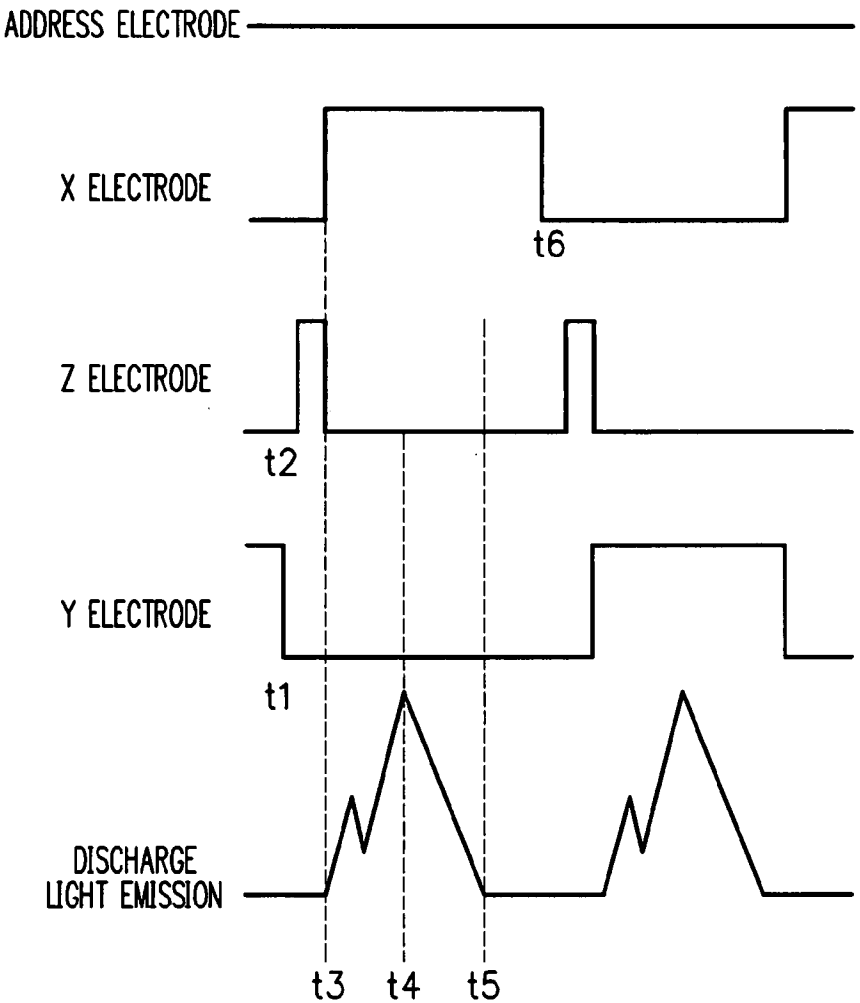
FIG. 6B is a diagram showing a voltage waveform of each electrode and a discharge light emission waveform.
Figure 6A:
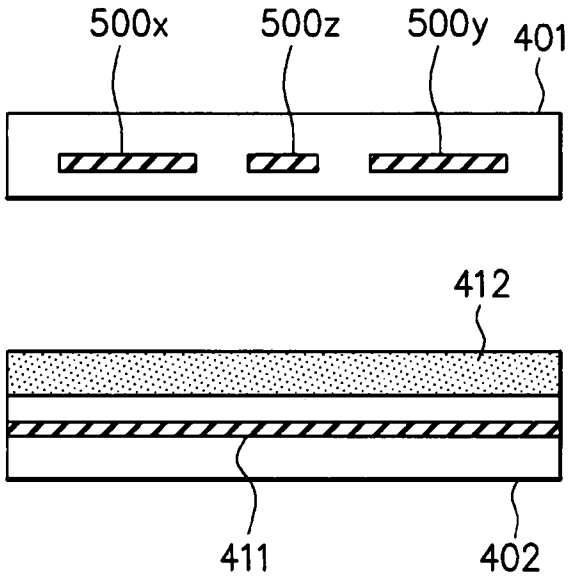
FIG. 6A is a cross sectional view of a plasma display panel.

FIG. 6A is a cross sectional view of a plasma display panel in which the experiment was conducted, and FIG. 6B is a schematic diagram showing a voltage waveform of each electrode and a discharge light emission waveform in the sustain period Ts (FIG. 3) in the odd frame in which the experiment was conducted. More accurate waveforms will be explained later with reference to FIG. 9 and FIG. 10. The front substrate 401 has the X electrode 500*x*, the Y electrode 500*y*, and the Z electrode 500*z*. The backside substrate 402 has the address electrode 411 and the phosphor layer 412.

In FIG. 6B, the address electrode 411 keeps a voltage of 0V. Before time t1, the X electrode 500*x* is at −88 V, the Z electrode 500*z* is at −88 V, and the Y electrode 500*y* is at +88 V. At time t1, the Y electrode 500*y* is reduced in voltage from +88 V to −88V. Next, at time t2, the Z electrode 500*z* is raised in voltage from −88 V to +88 V. As a result, +176 V is applied between the Z electrode 500*z* and the Y electrode 500*y* and the charged particle density becomes high. However, discharge light emission is not generated yet. Next, at time t3, the Z electrode 500*z* is reduced in voltage from +88 V to −88 V and the X electrode 500*x* is raised in voltage from −88 V to +88 V. As a result, +176 V is applied between the X electrode 500*x* and the Y electrode 500*y* and a main discharge is generated between the X electrode 500*x* and the Y electrode 500*y* and discharge light emission starts. To be more accurately, the discharge light emission starts immediately before time t2. The discharge light emission rises in two steps, a peak light emission is generated at time t4, and at time t5, the discharge light emission ends. After this, at time t6, the X electrode 500*x* is reduced in voltage from +88 V to −88 V. By repeating the above-mentioned processes, a sustain discharge is generated between the X electrode 500*x* and the Y electrode 500*y*. It is preferable for pulse widths t2 and t3 of the Z electrode to be 100 ns to 500 ns. The luminous efficiency at this time is 1.91 [lm/W]. Additionally, the discharge gas between the front substrate 401 and the backside substrate 402 includes 5% of Xe and 30% of He, and the rest is Ne.

FIG. 5B is a diagram showing an electrode structure of a three-electrode structured plasma display panel, which is an object to be compared in the experiment. The three-electrode structure has the address electrode A, the X electrode X, and the Y electrode Y. The three-electrode structure in FIG. 5B differs from the four-electrode structure in FIG. 5A in that the Z electrode 500*z* is removed. However, it is necessary to reduce the distance Sg in order to cause a discharge to generate by applying 176 V between the transparent electrodes 502*x* and 502*y*. The experiment was conducted with Sg set to 100 μm. Other distances are the same as those in FIG. 5A. In the three-electrode structure in FIG. 5B, the luminous efficiency was found to be 1.25 [lm/W] from the experimental result.

The luminous efficiency in the four-electrode structure in the present embodiment in FIG. 5A is 1.91 [lm/W] and the luminous efficiency has considerably increased compared to the three-electrode structure in FIG. 5B. However, the luminous efficiency has increased only under predetermined conditions and when the predetermined conditions were not met, no increase in the luminous efficiency was observed more than that in the three-electrode structure.

Even in the three-electrode structure in FIG. 5B, it is possible to cause a sustain discharge to generate. The longer the minimum distance Sg between the transparent electrodes 502*x* and 502*y*, the more the luminous efficiency increases. However, if the distance Sg is increased, a discharge is not caused to generate between the transparent electrodes 502*x* and 502*y* unless a higher voltage is applied between the transparent electrodes 502*x* and 502*y* and as a result, a large consumption power is required.

The four-electrode structure in FIG. 5A realizes an increase in the luminous efficiency and reduction in consumption power. It is possible to increase the luminous efficiency by increasing the minimum distance Sg between the transparent electrodes 502*x* and 502*y*. Further, it is possible to cause discharge light emission to generate by providing the Z electrode 500*z* to apply a low voltage of 176 V between the transparent electrodes 502*x* and 502*y*. In the case of a four-electrode structure, a voltage to be applied between the X electrode and the Y electrode for discharge light emission may be one lower than a minimum voltage with which a discharge is caused to generate between the X electrode and the Y electrode without application of a pulse to the Z electrode.

Next, there will be explained the theory of the above-mentioned experimental result. According to the present embodiment, it is possible to considerably increase the luminous efficiency and to make an attempt to reduce power consumption and the cost and to increase luminance. First, there will be explained a case where the voltages shown in FIG. 6B are applied to the X electrode 500*x*, the Y electrode 500*y*, and the Z electrode 500*z*. At time t2, if −88 V is applied to the Y electrode 500*y* and +88 V is applied to the Z electrode 500*z*, electrons (negative charges) are attracted onto the Z electrode 500*z* and ions (positive charges), onto the Y electrode 500*y*. Due to this, the electron density begins to increase in the vicinity of the surface of the Z electrode 500*z*. At time t3, when the electron density has increased and before light emission and discharge current between the Z and Y electrodes are generated, +88 V is applied to the X electrode 500*x*, −88 V is applied to the Y electrode 500*y*, and −88 V is applied to the Z electrode 500*z*. Following this, light emission between the Z and Y electrodes starts to generate, however, the discharge current between the Z and Y electrodes (the current that flows in the positive direction from the Z electrode) that has once started to flow begins to decrease immediately because of the change in the voltage of the Z electrode 500*z* to −88 V. At the same time, due to the difference in potential applied between the X and Z electrodes, the electrons begin to be attracted to the X electrode 500*x* and the ions, to the Z electrode 500*z*. Due to this, ionization further advances in the display cell and the electron density increases. The discharge current (the current that flows in the negative direction toward the Z electrode) once flows between the X and Z electrodes, however, a long distance discharge is generated immediately between the X and Y electrodes and this discharge becomes dominant. It is possible for a long distance discharge to utilize light emission in a positive column region in which the gradient of an electric field is flat. During the period of positive column discharge, input power is efficiently converted into ultraviolet rays, therefore, a high luminous efficiency can be obtained. As descried above, during one continuous discharge, there are both a period in which the Z electrode 500*z* causes a gas discharge current to flow in the positive direction and a period in which the current is caused to flow in the negative direction.

As described above, the positive and negative polarities of a voltage to be applied to each electrode are important. It is important to select a position in the path of a long distance discharge, at which the charged particle density of electrons with high mobility is increased in advance, before the main long distance discharge between the X electrode (anode) 500*x* and the Y electrode (cathode) 500*y*. Electrons have higher mobility than that of ions, therefore, it is preferable to increase in advance the charged particle density of electrons in the vicinity of the surface of the Z electrode 500*z*. This can be realized by the polarities of the voltages shown in FIG. 6B.

Next, in FIG. 6B, there will be explained a case where the polarities of the voltages of the X electrode 500*x*, the Y electrode 500*y*, and the Z electrode 500*z* are reversed. That is, at time t2, the X electrode 500*x* is at +88 V, the Y electrode 500*y* is at −88 V, and the Z electrode 500*z* is at −88V. In this state, ions are attracted onto the Z electrode 500*z* and electrons, onto the Y electrode 500*y*. Due to this, the electron density increases in the vicinity of the surface of the Y electrode 500*y*. Next, at time t3, when the X electrode 500*x* changes to −88 V, the Y electrode 500*y* to +88 V, and the Z electrode 500*z* to +88 V, since the electrons are in the vicinity of the surface of the Y electrode 500*y* with respect to the electric field between the Y electrode 500*y* and the Z electrode 500*z*, they are not accelerated by the electric field (they do not contribute to ionization) and there is no avalanche increase. In other words, the charged particle density between the Z electrode 500*z* and the Y electrode 500*y* does not increase. As a result, a high voltage is required between the X electrode 500*x* and the Y electrode 500*y* in order to cause a long distance discharge to generate. Since the temperature of the electrons is high, the loss is great. Therefore, the polarities of the voltages shown in FIG. 6B are preferable.

Figure 8:
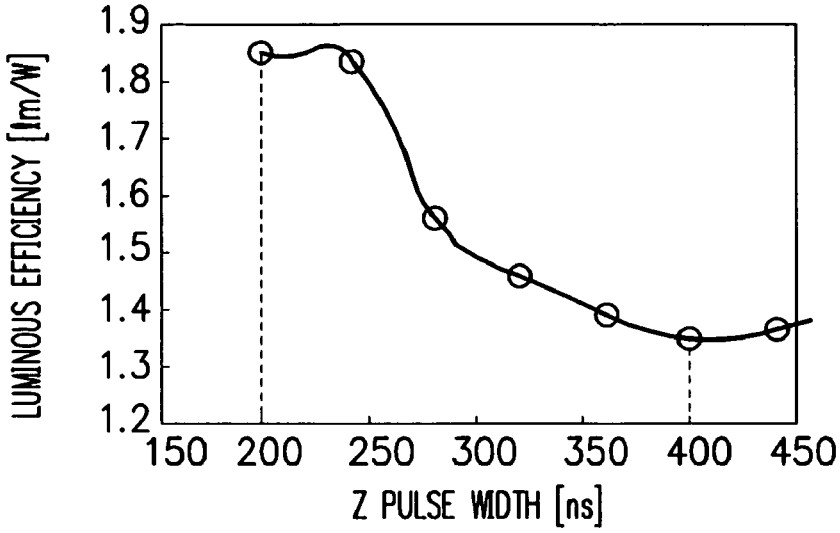
FIG. 8 is a graph of an experimental result showing luminous efficiency and the pulse width of a Z electrode.
Figure 9:
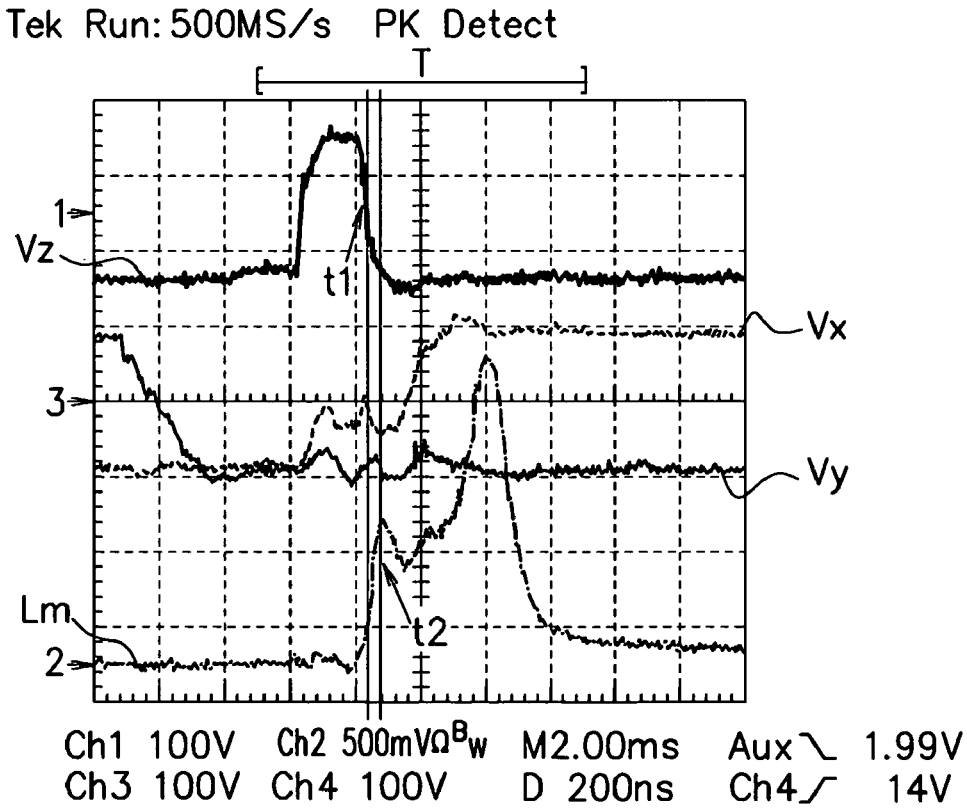
FIG. 9 is a diagram showing the voltage waveform of each electrode observed by an oscilloscope when the pulse width of the Z electrode is 200 ns.
Figure 10:
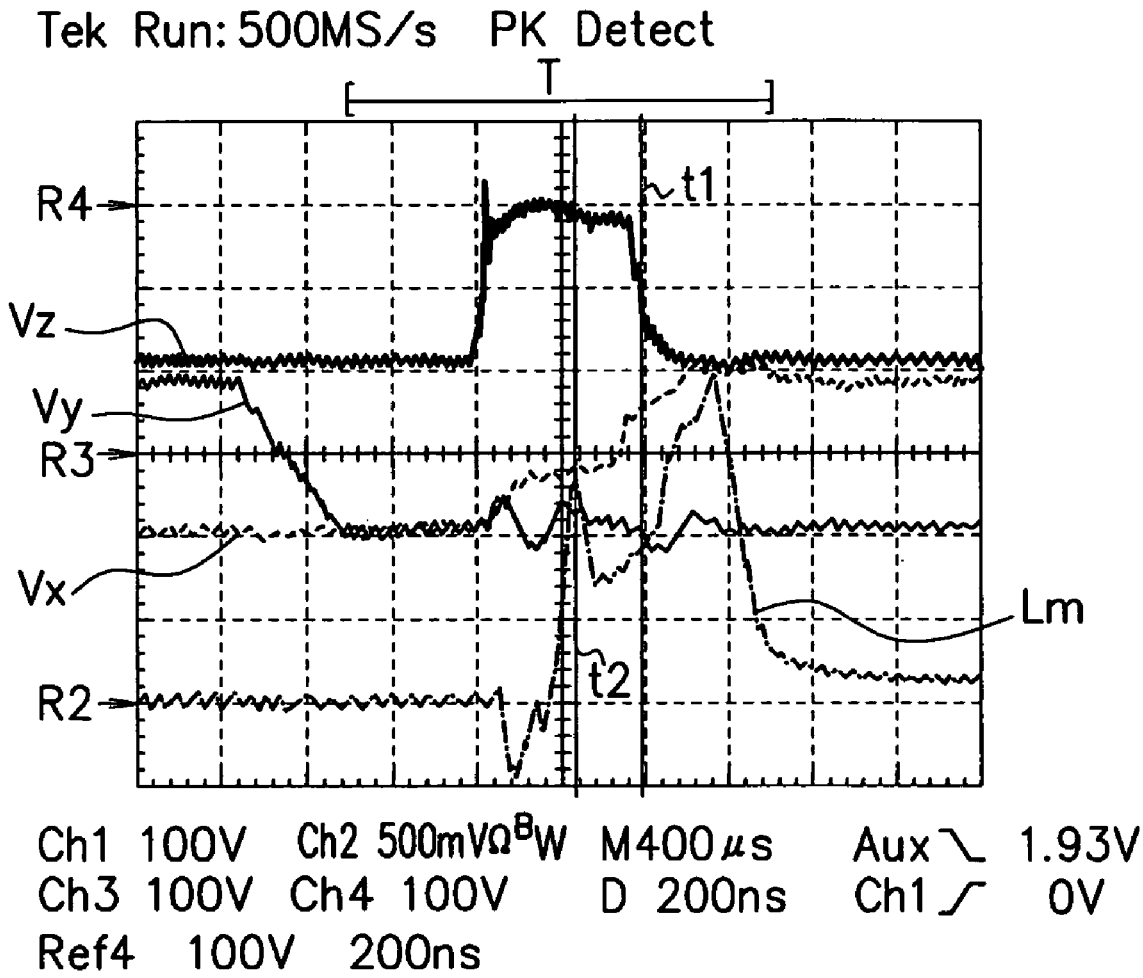
FIG. 10 is a diagram showing the voltage waveform of each electrode observed by an oscilloscope when the pulse width of the Z electrode is 400 ns.

FIG. 8 is a graph of the experimental result showing a relationship between the pulse width (half value width) of the Z electrode and the luminous efficiency. FIG. 9 is a diagram showing the voltage waveforms of each electrode observed by an oscilloscope when the pulse width of the Z electrode is 200 ns in the experimental result in FIG. 8. FIG. 10 is a diagram showing the voltage waveforms of each electrode observed by an oscilloscope when the pulse width of the Z electrode is 400 ns in the experimental result in FIG. 8. A voltage Vx shows the voltage waveform of the X electrode, a voltage Vy shows the voltage waveform of the Y electrode, and a voltage Vz shows the voltage waveform of the Z electrode. Light emission Lm is a light emission waveform with the phosphors depending on the discharge generated by application of the voltages of the X electrode, the Y electrode, and the Z electrode. In FIG. 9 and FIG. 10, one block between neighboring dotted lines of the time on the horizontal axis corresponds to 200 ns.

The pulse width of the Z electrode is varied by fixing the rise time of the pulse and adjusting the fall time. When the pulse width of the Z electrode is increased, the timing of the fall time of the pulse is shifted backward.

In FIG. 8, when the pulse width of the Z electrode is equal to or less than 250 ns, a high luminous efficiency of 1.8 [lm/W] or higher can be obtained and when it exceeds 250 ns, the luminous efficiency decreases. It is preferable for the half value width of the pulse of the Z electrode to be not less than 100 ns and not more than 250 ns.

In FIG. 9, the pulse width is 200 ns and the luminous efficiency is 1.84 [lm/W]. A pulse is applied to the Z electrode (the third electrode) in each time discharge light emission is made to generate by applying an alternating pulse between the X electrode (the first electrode) and the Y electrode (the second electrode). At this time, it is preferable that time t1 at which the pulse Vz of the Z electrode reaches 50% of its amplitude in the fall (at the trailing edge) takes place before time t2 of the first peak of the light emission waveform Lm. In this state, it was possible to obtain a high luminous efficiency. Further, there is a characteristic that there are two or more peaks in the light emission waveform Lm during one continuous discharge.

It is also preferable that time t1 at which the pulse Vz of the Z electrode reaches 50% of its amplitude in the fall time takes place before the time at which the pulse Vx to be applied to the X electrode reaches 90% of its amplitude in the rise time. Preferably, the pulse Vz of the Z electrode is a positive pulse, however, it may be a negative pulse. The voltage waveforms of the X electrode and the Y electrode may be opposite each other. In other words, it may also be possible to apply the voltage Vy to the X electrode and the voltage Vx to the Y electrode. In this case, it is preferable that time t1 at which the pulse Vz of the Z electrode reaches 50% of its amplitude at the trailing edge (in the case of FIG. 9, in the fall) takes place before the time at which the pulse to be applied between the X electrode and the Y electrode reaches 90% of its amplitude at the leading edge (in FIG. 9, in the rise).

It is also preferable that the time at which the pulse Vz of the Z electrode reaches 10% of its amplitude in the rise time takes place simultaneously or within 100 ns of the time lag in which the pulse Vx to be applied to the X electrode reaches 10% of its amplitude in the rise time. Preferably, the pulse Vz of the Z electrode is a positive pulse, however, it may be a negative pulse. Further, the voltage waveforms of the X electrode and the Y electrode may be opposite. In this case, it is preferable that the time at which the pulse Vz of the Z electrode reaches 10% of its amplitude at the leading edge (in FIG. 9, in the rise) takes place simultaneously or within 100 ns of the time lag at which the pulse to be applied between the X electrode and the Y electrode reaches 10% of its amplitude at the leading edge (in FIG. 9, in the rise).

In FIG. 10, the pulse width is 400 ns and the luminous efficiency is 1.35 [lm/W]. Time t1 at which the pulse Vz of the Z electrode reaches 50% of its amplitude in the fall (at the trailing edge) takes place after time t2 of the first peak of the light emission waveform Lm. In this state, it was not possible to obtain a high luminous efficiency.

From the experimental result described above, in FIG. 5A, the longer is the minimum distance Sg between the X electrode 502*x* and the Y electrode 502*y*, the higher is the luminous efficiency, and thus it is preferable that the minimum distance Sg is equal to or more than 200 μm. Further, it is preferable for the minimum distance Tg between the X electrode 502*x* and the Z electrode 502*z* and the minimum distance Tg between the Y electrode 502*y* and the Z electrode 502*z* to be not less than 50 μm and not more than 150 μm.

Figure 7:
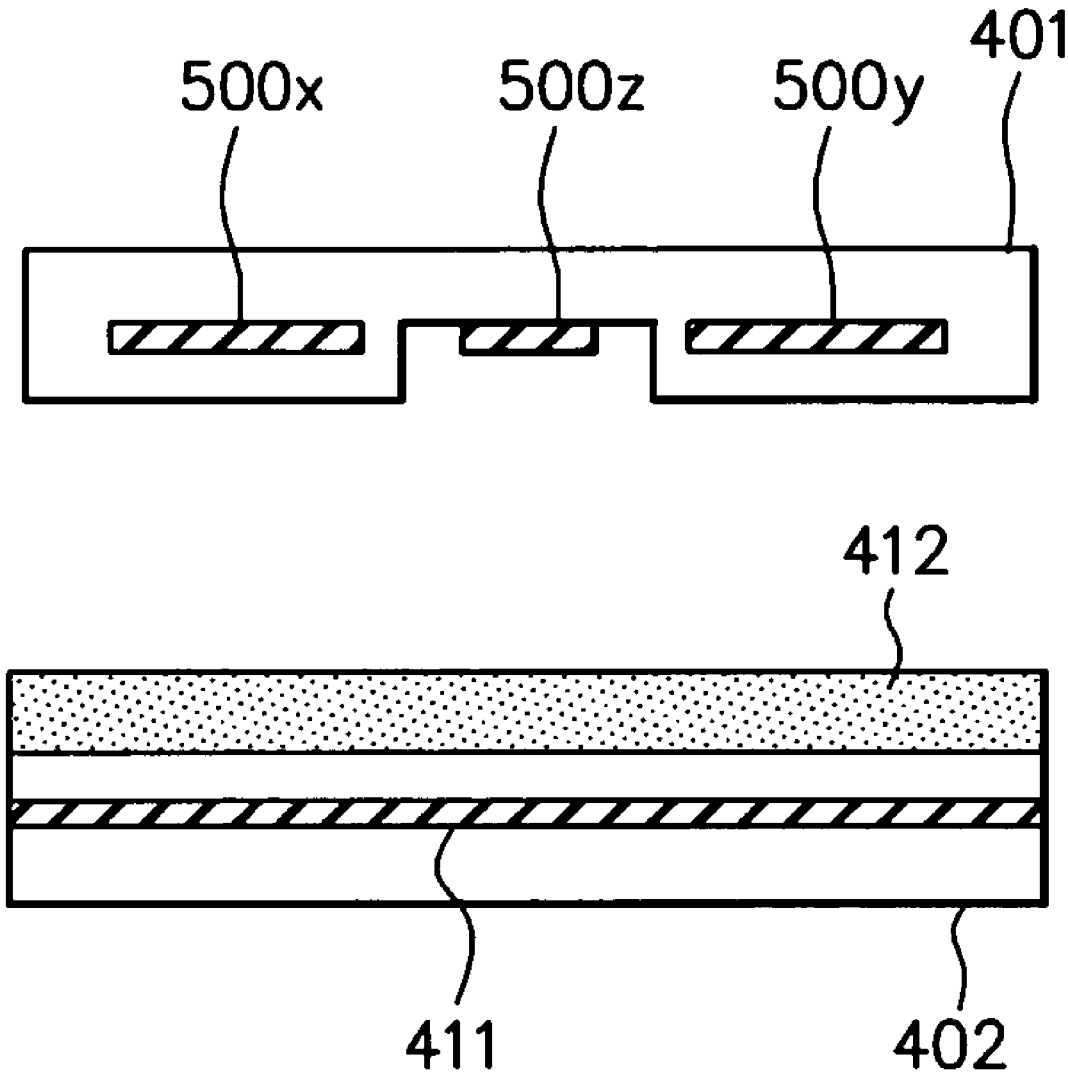
FIG. 7 is a cross sectional view of another plasma display device.

FIG. 7 is a cross sectional view of another plasma display panel instead of the plasma display panel in FIG. 6A. The Z electrode 500*z* may be exposed to the discharge space on the front substrate 401. The present embodiment can be applied also to this plasma display panel.

The embodiments described above show only concrete examples where the present invention is embodied and should not be interpreted to limit the technical scope of the present invention. In other words, the present invention can be applied in various forms without departing from the technical concept and the main features.

It is possible to reduce the voltage to be applied between the first and second electrodes by providing the third electrode. Further, it is possible to improve the luminous efficiency by bringing the timing of the third pulse under specific conditions.

What is claimed is:

1. A plasma display device comprising:

a first and a second electrode;

a third electrode arranged between said first and second electrodes;

a fourth electrode intersecting with said first, second and third electrodes; and a drive circuit, which applies an alternating pulse between said first and second electrodes within a sustain discharge period and applies a pulse to said third electrode every time it applies said alternating pulse, and, the pulse applied to said third electrode has a half-value width of not less than 100 ns and not more than 250 ns, and a time which the pulse reaches 50% of its amplitude in a trailing edge takes place before a time of the first peak of a light emission of discharge by said pulse or said alternating pulse.

2. The plasma display device according to claim 1, wherein a voltage between said first and second electrodes at a time of applying said alternating pulse is a lower than a discharge starting voltage between said first and second electrodes in only said first and second electrodes.

3. The plasma display device according to claim 1, wherein a time at which the pulse of said third electrode reaches 50% of its amplitude in a trailing edge takes place before a time at which the pulse to be applied between said first and second electrodes reaches 90% of its amplitude in a leading edge.

4. The plasma display device according to claim 3, wherein a time at which the pulse of said third electrode reaches 50% of its amplitude in the fall time takes place before a time at which the pulse to be applied to said first or second electrode reaches 90% of its amplitude in the rise time.

5. The plasma display device according to claim 1, wherein a time at which the pulse of said third electrode reaches 10% of its amplitude in the leading edge takes place simultaneously or within 100 ns of a time lag in which the pulse to be applied between said first and second electrodes reaches 10% of its amplitude in the leading edge.

6. The plasma display device according to claim 5, wherein a time at which the pulse of said third electrode reaches 10% of its amplitude in a rise time takes place simultaneously or within 100 ns of a time lag in which the pulse to be applied to said first or second electrode reaches 10% of its amplitude in the rise time.

7. The plasma display device according to claim 1, wherein a minimum distance between said first and second electrodes is equal to or more than 200 μm.

8. The plasma display device according to claim 7, wherein the minimum distance between said first and third electrodes and the minimum distance between said second and third electrodes are not less than 50 μm and not more than 150 μm.

9. The plasma display device according to claim 1, wherein said first to third electrodes are provided on the same substrate.

10. The plasma display device according to claim 1, wherein said first to third electrodes are provided in parallel to one another.

11. The plasma display device according to claim 10, wherein said third electrode is provided between said first and second electrodes.

12. The plasma display device according to claim 10, further comprising an address electrode provided so as to intersect said first to third electrodes.

13. The plasma display device according to claim 12, further comprising:

a first substrate provided with said first to third electrodes; and a second substrate provided in opposition to said first substrate and provided with said address electrode.

14. The plasma display device according to claim 1, wherein the pulse of said third electrode is a positive pulse.

15. The plasma display device according to claim 1, wherein said light emission waveform has two or more peaks during one continuous discharge.

16. The plasma display device according to claim 1, wherein there are provided both a period in which said third electrode causes discharge current to flow in the positive direction and a period in which said third electrode causes discharge current to flow in the negative direction during one continuous discharge.

17. A method for driving a plasma display device, which has a first and a second electrode, a third electrode arranged between said first and second electrodes, and a fourth electrode which intersects with said second and third electrodes and parallel to each other, said method comprising:

a driving operation for applying an alternating pulse between said first and second electrodes, within a sustain discharge period and for applying a pulse to said third electrode every time said alternating pulse is applied, wherein, the pulse applied to said third electrode has a half-value width of not less than 100 ns and not more than 250 ns, and a time which the pulse reaches 50% of its amplitude in a trailing edge takes a place before a time of the first peak of a discharge by said pulse or said alternating pulse.

18. A method for driving a device having a first and a second electrode with a third electrode therebetween and a fourth electrode intersecting with the second and third electrodes, the said method comprising:

applying a first pulse between the first and second electrodes within a sustain discharge period and a second pulse to the third electrode every time the first pulse is applied and having a half-value width between 100 ns and 250 ns, and reaching 50% of its amplitude in a trailing edge before a time of a first peak of a discharge by the first pulse or the second pulse.

* * * * *

UNITED STATES PATENT AND TRADEMARK OFFICE

CERTIFICATE OF CORRECTION

PATENT NO. : 7,667,671 B2
APPLICATION NO. : 11/340836
DATED : February 23, 2010
INVENTOR(S) : Tomokatsu Kishi et al.

It is certified that error appears in the above-identified patent and that said Letters Patent is hereby corrected as shown below:

Column 10, Line 10, change "electrodes," to --electrodes--.

Signed and Sealed this

Eleventh Day of May, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,667,671 B2
APPLICATION NO. : 11/340836
DATED : February 23, 2010
INVENTOR(S) : Kishi et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1033 days.

Signed and Sealed this

Seventh Day of December, 2010

David J. Kappos

David J. Kappos
*Director of the United States Patent and Trademark Office*